US005103708A

United States Patent [19]

Steinberger

[11] Patent Number: 5,103,708

[45] Date of Patent: Apr. 14, 1992

[54] GEARLESS TUNER

[75] Inventor: Ned Steinberger, Cornwall, N.Y.

[73] Assignee: Steinberger Sound Corporation, Newburgh, N.Y.

[21] Appl. No.: 641,741

[22] Filed: Jan. 16, 1991

[51] Int. Cl.[5] ..... G10D 3/14

[52] U.S. Cl. ..... 84/304

[58] Field of Search ..... 84/200-208, 84/297 R, 304, 305, 306

[56] References Cited

U.S. PATENT DOCUMENTS

| | | | |
|---|---|---|---|
| 345,711 | 7/1886 | McMillan | 84/206 |
| 542,157 | 7/1895 | Gosse | 84/306 |
| 594,325 | 11/1897 | Christie | 84/205 X |
| 918,543 | 4/1909 | Haubner | 84/306 |
| 1,384,459 | 7/1921 | Grover | 84/305 |
| 1,577,245 | 3/1926 | Bua | 84/312 R |
| 1,580,667 | 4/1926 | Hanson | 84/304 |
| 1,713,002 | 5/1929 | Oettinger | 84/304 |
| 3,023,658 | 3/1962 | Gusey | 84/306 |
| 3,830,132 | 8/1974 | Lowe | 84/304 |
| 4,191,086 | 3/1980 | Spercel | 84/306 |
| 4,367,671 | 1/1983 | Chancel et al. | 84/306 |
| 4,452,120 | 6/1984 | Chance et al. | 84/306 |
| 4,625,614 | 12/1986 | Spercel | 84/306 |
| 4,674,387 | 6/1987 | Caruth | 84/304 |
| 4,768,415 | 9/1988 | Gressett, Jr. et al. | 84/298 |
| 4,872,388 | 10/1989 | Gunn | 84/297 |
| 5,018,424 | 5/1991 | Steinberger | 84/304 |

FOREIGN PATENT DOCUMENTS 231064 7/1924 United Kingdom .

*Primary Examiner*—L. T. Hix
*Assistant Examiner*—Howard B. Blankenship
*Attorney, Agent, or Firm*—Finnegan, Henderson, Farabow, Garrett & Dunner

[57] ABSTRACT

A gearless tuner for a stringed musical instrument comprises a generally cylindrical housing for mounting on the instrument including an axial opening extending therethrough; a knob core sized for insertion into the axial opening in the housing including a threaded aperture extending axially therethrough and an annular ring for interacting with the housing to maintain the knob core in the housing; and an elongated slider extending into the axial opening of the housing and axially threaded into the aperture for securing one end of a string of the instrument and drawing the string into the housing when the knob core is rotated with respect to the housing to tension the string, including a string opening through the slider substantially parallel to the direction of the string on the instrument for receiving the string, and locking means both for allowing the slider to move axially with respect to the housing and preventing the slider from rotating with respect to the housing.

21 Claims, 4 Drawing Sheets

GEARLESS TUNER

BACKGROUND OF THE INVENTION

1. Summary of the Invention

The present invention relates to devices for tuning the strings of a musical instrument. More particularly, the invention relates to gearless tuners which allow for easy installation and tuning of the strings of the instrument.

2. Description of Related Art

Numerous mechanisms have been utilized in the prior art for adjusting the strings of musical instruments to proper tension. Many of these tuning machines utilize gear arrangements for transferring the rotational motion from a tuning peg to a string retaining member. For example, U.S. Pat. No. 4,872,388 describes a string anchoring and trimming device in which a tuning peg 104 is coupled to a string barrel 105 through a worm gear. Devices such as this are subject to difficulties in attaching the string, and tuning of the string may be less accurate due to the interface of the worm gear.

Gearless tuners have also been known in the prior art. For example, U.S. patent application Ser. No. 265,693, filed Nov. 1, 1988 by the same inventor as the present application, describes a tuning machine to which a string may be rapidly attached and quickly tuned while simultaneously shearing off excess string from the free end thereof. U.S. Pat. No. 3,830,132 to Lowe discloses a tuning peg in which the string is attached to an axially movable slider, wrapped around the slider one or more times and placed in a groove in the top of the slider. The slider is then moved along the axis of a screw into a housing in the instrument to tension the string. Both of the above-described tuners may be easily installed into the musical instrument. However, in both cases, the main components of the tuning machine must be disassembled in order to install the machine on the instrument. Also, with the device of Lowe, the string must be wound around the slider, which takes some additional time and effort.

Accordingly, it is an object of this invention to provide a tuner for a stringed musical instrument which may be quickly and easily installed on the instrument, and in which the main components may be preassembled without the need for substantial disassembly during installation.

It is an additional object of the invention to rapidly secure a plain string of an instrument to a tuner without substantially deforming the string.

It is a further object of the invention to easily secure a wound string of an instrument in a tuner with increased pinching of the string.

It is a further object of the invention to quickly attach a string of an instrument to a tuner and tune the string without the need for cutting or breaking excess string from the tuner.

A still further object of the invention is to rapidly install a tuning machine in a preexisting hole on a guitar neck.

Additional objects and advantages of the invention will be set forth in the description which follows, and in part will be obvious from the description, or may be learned by practice of the invention.

SUMMARY OF THE INVENTION

To achieve the foregoing objects, and in accordance with the purposes of the invention as embodied and broadly described herein, the gearless tuner for stringed musical instrument comprises a generally cylindrical housing means for mounting on the instrument, including an axial opening extending therethrough. A knob core is sized for insertion into the axial opening in the housing means, and includes a threaded aperture extending axially therethrough, and annular means for interacting with the housing means to maintain the knob core in the housing means. Elongated slider means extend into the axial opening of the housing means and are axially threaded into the aperture for securing one end of the string of the instrument and drawing the string into the housing means when the knob core is rotated with respect to the housing means to tension the string. The slider means includes a string opening through the slider means substantially parallel to the direction of the string on the instrument for receiving the string, and locking means both for allowing the slider to move axially with respect to the housing means and preventing the slider from rotating with respect to the housing means.

It is preferred that the housing means include a cylindrically-shaped housing having a flange portion thereon, the flange portion including an integral bearing surface for contact with the string when the knob core is rotated with respect to the housing means. It is also preferable that the flange portion include a radial knurl for substantially preventing relative rotation between the housing and the instrument when the tuner is secured to the instrument. The housing may include a reduced diameter section and the annular means may be an annular ring member for interacting with the reduced diameter section to maintain the knob core in threaded relationship with the slider means. In addition, a tuning knob may be provided, and the knob core may include groove means for locking the tuning knob onto the knob core.

It is preferred that the slider means include clamping means for securing the string in the string opening, and the string opening preferably includes string securing surface means for interacting with the clamping means to secure a plain string of the instrument substantially without deforming the string to avoid breakage of the string. Alternatively, the clamping means may include an outer ring and a central depression for providing increased pinching of wound strings.

It is preferred that the slider means include clearance means for receiving the string as the slider means is drawn into the housing means upon rotation of the knob core. The clearance means may include at least one cutaway portion adjacent to the string opening for receiving excess string exiting the opening without interfering with movement of the slider means into the housing means during tuning of the string.

Preferably, the bearing surface includes a substantially smooth curved surface completely surrounding the housing.

The invention also includes a method of installing a tuning machine in a preexisting hole on a guitar neck, comprising the steps of inserting a subassembly, including a cylindrical housing having a flange on one end and threads on the other end, a knob core substantially within the housing having a axial threaded aperture and a slider threaded into the aperture for movement into the housing, through the hole in the guitar neck; attaching a nut onto the threaded end of the housing to secure the subassembly to the neck; and mounting a tuning knob on the end of the knob core. Preferably, a friction reducing washer is installed onto the knob core before the knob is mounted. The friction reducing washer also may be preinstalled or press fit into the knob prior to assembly.

BRIEF DESCRIPTION OF THE DRAWINGS

The accompanying drawings, which are incorporated in and constitute a part of the specification, illustrate a presently preferred embodiment of the invention and, together with the description, serve to explain the principles of the invention.

DESCRIPTION OF THE PREFERRED EMBODIMENT

Reference will now be made in detail to the present preferred embodiment of the invention as illustrated in the accompanying drawings.

The present invention is a gearless tuner for a string musical instrument. In accordance with the invention, the tuner comprises a generally cylindrical housing means for mounting on the instrument, including an axial opening extending therethrough; a knob core sized for insertion into the axial opening housing means, including a threaded aperture extending axially therethrough, and annular means for interacting with the housing means to maintain the knob core in the housing means; and elongated slider means extending into the axial opening of the housing means and axially threaded into the aperture for securing one end of a string of the instrument and drawing the string into the housing means to tension the string, including a string opening through the slider means substantially parallel to the direction of the string on the instrument for receiving the string, and locking means both for allowing the slider to move axially with respect to the housing means and preventing the slider means from rotating with respect to the housing means.

Figure 6:
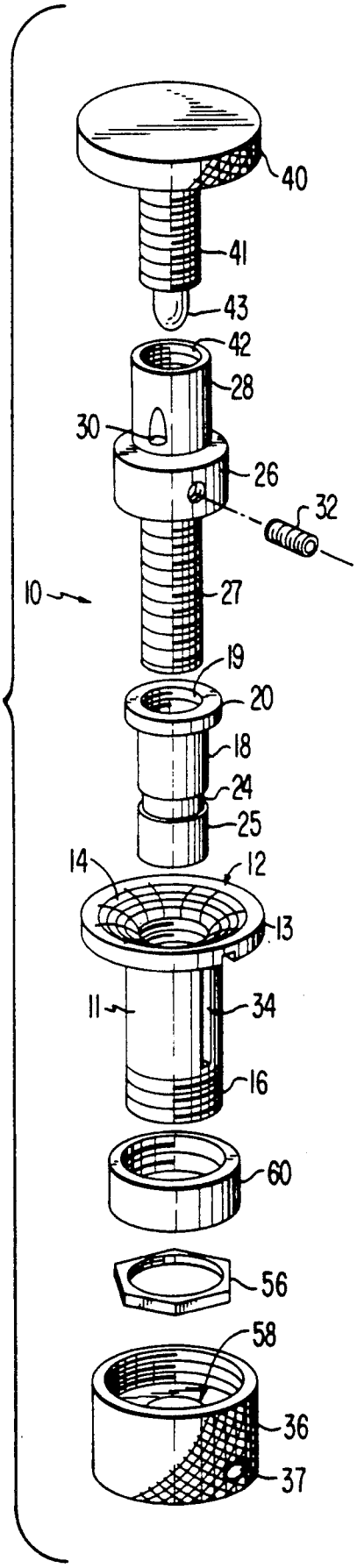
FIG. 6 is an exploded perspective view of the tuner of the invention.
Figure 7:
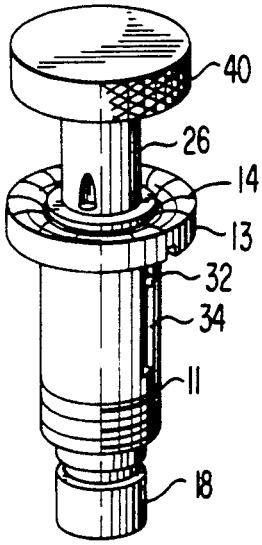
FIG. 7 is a perspective view of the tuner in assembled condition.

As best shown in FIG. 6, the tuner, generally designated by the numeral 10, is designed for mounting in the hole of a head stock of a stringed instrument, such as a guitar. In the illustrated embodiment, the housing means includes a generally cylindrical housing 11 having an axial opening 12 extending therethrough. A flange portion 13 is arranged on one end of the housing 12. During installation of the tuner on an instrument, the flange portion 13 forms an outer rim which abuts against the edges of a hole in the instrument. Preferably, the flange portion 13 includes a bearing surface 14 thereon for contact with the string of the instrument. The bearing surface 14 preferably has a substantially smooth curved surface, which completely surrounds the axial opening 12. The bearing surface 14 may be formed integrally with the housing 11 including the flange 13.

Figure 1:
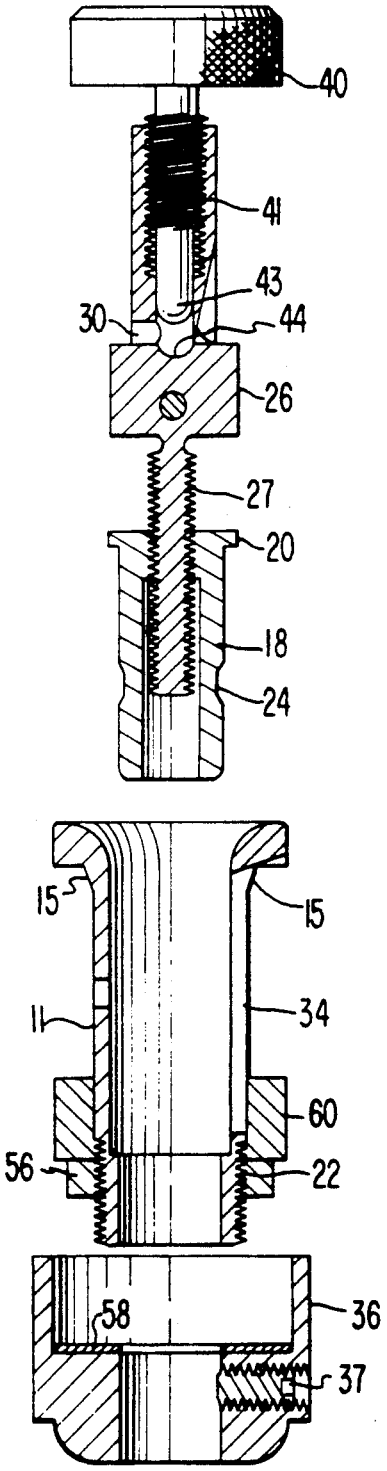
FIG. 1 is a cross-section of the tuner of the present invention with the knob core and slider means removed from the housing.
Figure 3:
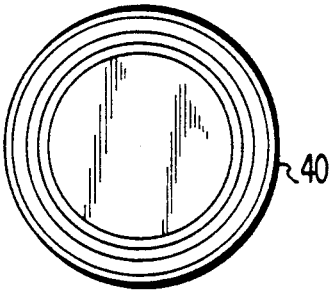
FIG. 3 is a top view of the tuner of FIG. 2.

As shown in FIG. 1, the flange portion 13 may include a radial knurl 15 on the side opposite the bearing surface 14 for substantially preventing relative rotation between the housing 11 and the instrument 70 when the tuner 10 is secured to the instrument.

The housing has a threaded portion 16 thereon at the end opposite to flange portion 13 for attaching the housing to the instrument.

As illustrated in FIG. 6, a knob core 18 is sized for insertion into the axial opening 12 in the housing 11. The knob core 18 includes a threaded aperture 19 extending axially therethrough. In addition, one end of the knob core includes an annular ring 20 for interacting with the housing to maintain the knob core 18 in the housing 11. As shown in FIG. 1, the housing 11 includes a stepped portion 22 of reduced diameter which abuts against the annular ring 20 when the knob core is fully inserted into the housing 11. This prevents accidental disassembly of the tuner, and maintains the knob core in threaded relationship with the slider means when the tuner has been assembled. The knob core also includes a groove 24 for attaching and locking a tuning knob to the tuner (described hereinafter). Preferably, the groove 24 comprises a circular recessed portion completely surrounding the knob core 18.

In the illustrated embodiment, the elongated slider means includes a slider 26 which also extends into the axial opening of the housing 11. This slider 26 includes an axially threaded portion 27 which is attached into the threaded aperture 19 of the knob core 18. A reduced diameter portion 28 of the slider 26 includes a string opening 30 through the slider 26. The string opening 30 is arranged to be substantially parallel to the direction of the string on the instrument for receiving the string quickly and easily without the need to rotate or wind the string or cut the string. In the illustrated embodiment, the locking means includes a locking pin 32 extending from the slider 26. The slot means comprises an axially extending slot 34 in the housing terminating at one end thereof at the flange portion 13 without intersecting the bearing surface 14. This slot 34 interacts with the locking pin 32 to secure the slider 26 and the knob core 18 in the housing 11. As a result, the slider 26 is allowed to move axially with the housing 11, but is prevented from rotating with respect to the housing 11.

Preferably, the tuner also includes a tuning knob 36 including at least one set screw 37 for insertion into the groove 24 on the knob core 18. This locks the knob 36 onto the knob core 18 for rotation therewith. The outer surface of the knob 36 is preferably knurled to allow for ease of handling and tightening. A contact portion 25 of the knob core 18 closely mates with the knob 36 for accurate tuning of the string.

Figure 8:
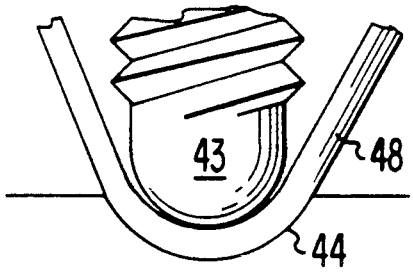
FIG. 8 is an enlarged partial view showing the clamping of a plain string in accordance with the invention.
Figure 9:
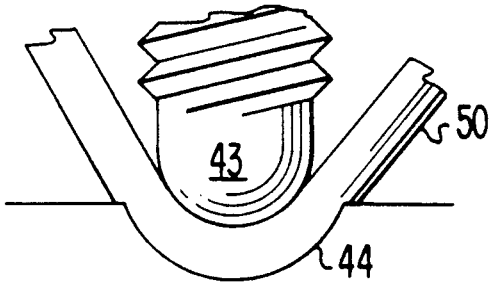
FIG. 9 is an enlarged partial view of the clamping means with a wound string.
Figure 10:
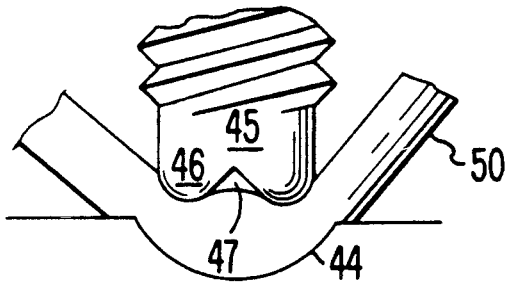
FIG. 10 is an enlarged partial view of an alternative configuration for the clamping means for use with wound strings.

In accordance with the invention, the instrument may include both plain and wound strings, and the slider means preferably includes clamping means for securing a string in the string opening. In addition, the string opening may include string securing surface means for interacting with the clamping means to secure the plain strings without substantially deforming the string to avoid breakage of the plain string. In the illustrated embodiment, the clamping means includes a clamping member 40 having an elongated threaded portion 41 thereon. A set of matching threads 42 is provided in the slider 26 for receiving the clamping member 40. A clamping face 43 is arranged on one end of the clamping member. As illustrated in FIGS. 8, 9 and 10, the string securing surface means includes a securing surface 44 in the string opening 30. The clamping face 43 interacts with the securing surface 44 to secure the string therebetween. Preferably, the clamping face 43 has a predetermined radius of curvature, and the securing surface 44 has a radius of curvature which is greater than the predetermined radius of curvature at least by the thickness of the largest plain string and less than the thickness of any of the wound strings on the instrument. By this arrangement, the force of the clamping member 43 on the string 48 is distributed over the securing surface 44, and the plain strings 48 are secured between the securing surface 44 and the clamping face 43 without substantially deforming the string. This results in reduced pinching and avoids breakage of the plain strings 48.

As shown in FIG. 9, this design results in increased pinching at the edges when a wound string 50 is inserted in the string opening 30. This provides an improved gripping action on the wound strings 10. As an alternative, the arrangement as shown in FIG. 10 may be used for the wound strings 50. In this embodiment, the clamping face 45 has an outer ring 46 and central depression 47. The wound string 50 is gripped securely between the outer ring 46 and the securing surface 44 while the center portion of the clamping face 43 is relieved. This increases the pinching action on the wound string 50. The clamping member 40 may be easily changed without disassembly of the tuner from the guitar.

Preferably, the slider means includes clearance means for receiving the string as the slider means is drawn into the housing means upon rotation of the knob core. In the illustrated embodiment, the clearance means includes the portion of reduced diameter 28. Alternatively, a cutaway portion (not shown) which only partially surrounds the slider 26, may be provided. The clearance or cutaway portion provides an area for receiving excess string exiting the string opening 30 without interfering with the movement of the slider 26 into the housing 11 during tuning of the string. This occurs as the slider 26 is drawn into the housing 11 upon rotation of the knob core 18, as described hereinafter.

Figure 11:
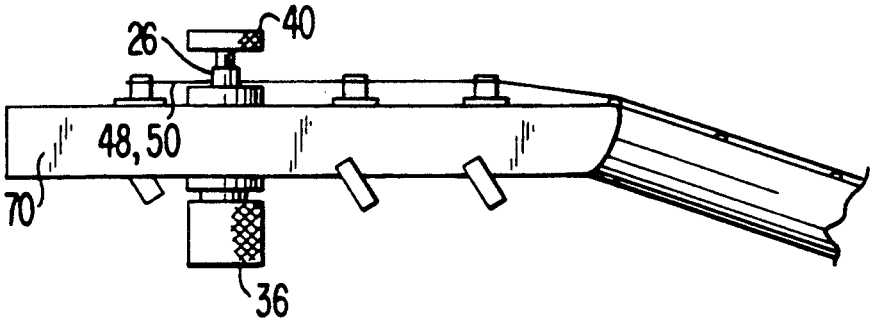
FIG. 11 is a side view of the tuner of the invention mounted on a guitar.

The present invention is particularly advantageous for installation on a guitar having a preexisting hole in the neck thereof, as shown in FIG. 11. This is particularly true where the diameter of the housing 11 is designed less than ⅝", which is the standard head stock hole size. In this case, the tuner may be substantially preassembled, and may be easily installed in a simple three step process. First, the subassembly which includes the cylindrical housing, the knob core and the slider, is inserted through the hole in the guitar neck. Thereafter, a nut 56, as shown in FIG. 6, is attached to the threaded end of the housing 11 to secure the subassembly to the neck. The tuning knob 36 is then mounted on the end of the knob core 18 by adjustment of the set screw 37. A friction reducing washer 58 may be installed onto the knob core 18 or press fit into the tuning knob 36 prior to mounting of the tuning knob 36. In addition, a spacer 60 may be placed on the housing 11 before attaching the nut 56. The spacer covers the nut 56 and improves the appearance of the tuner on the instrument.

Figure 2:
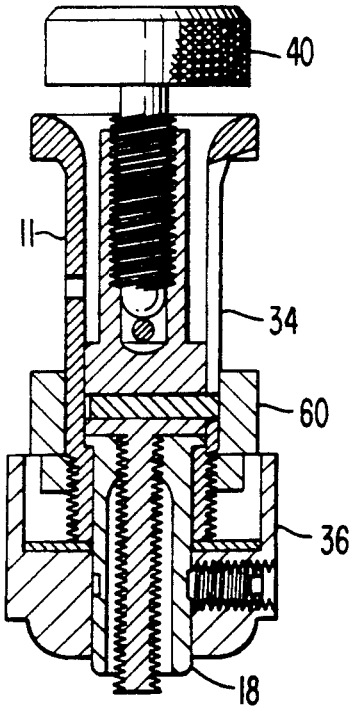
FIG. 2 is a cross-section of the tuner of the present invention in the fully assembled position.
Figure 4:
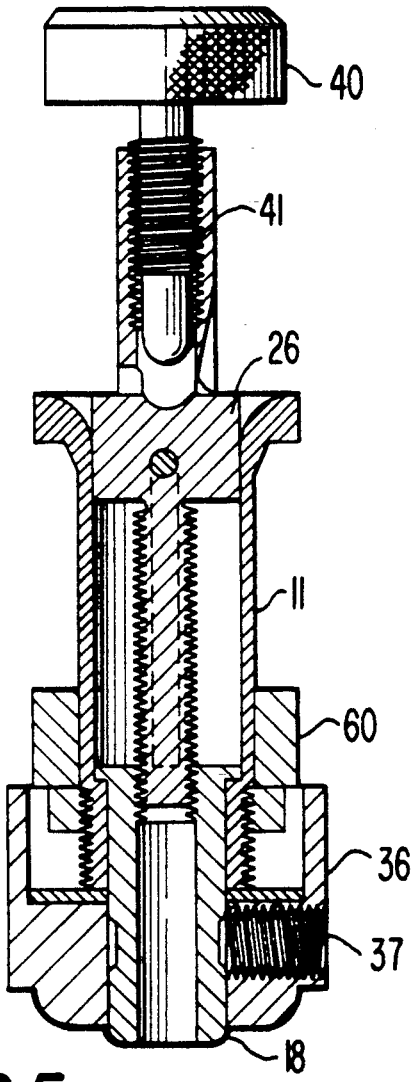
FIG. 4 is a cross-section of the tuner of the invention in assembled condition with the slider in its fully extended position.
Figure 5:
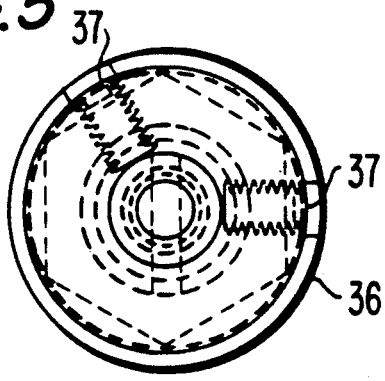
FIG. 5 is a bottom view of the tuner shown in FIG. 4.

In operation, the tuner provides a rapid an easy means of tuning a string of the instrument. The string 48, 50 is extended through the string opening 30 in slider 26. The clamping member 40 is then tightened to secure the string between the clamping face 43 and the securing surface 44. Tuning knob 36 is then rotated to move slider 26 axially from the position shown in FIG. 4 to the position shown in FIG. 2. The excess of the string 48, 50 is collected in the clearance space 28 between the slider 26 and the housing 11. Movement of the slider 26 in the axial direction changes the tension of the retained portion of the string 48, 50, thereby tuning the string.

The structure of the present invention, which is compact and has few parts, allows a simplified installation procedure. Once the main parts are assembled, the mechanism is captive and will not disassemble accidently.

Additional advantages and modifications will readily occur to those skilled in the art. The invention in its broader aspects is therefore not limited to the specific details, representative apparatus and illustrative examples shown and described. Accordingly, departures may be made from such details without departing from the spirit or scope of the general inventive concept defined by the appended claims and their equivalence.

What is claimed is:

1. A gearless tuner for a stringed musical instrument, comprising:

a generally cylindrical housing means for mounting on the instrument, including an axial opening extending therethrough;

a knob core sized for insertion into the axial opening in the housing means, including a threaded aperture extending axially therethrough, and annular means for interacting with the housing means to maintain the knob core in the housing means; and elongated slider means extending into the axial opening of the housing means and axially threaded into the aperture for securing one end of a string of the instrument and drawing the string into the housing means when the knob core is rotated with respect to the housing means to tension the string, including a string opening through the slider means substantially parallel to the direction of the string on the instrument for receiving the string, and locking means both for allowing the slider to move axially with respect to the housing means and preventing the slider means from rotating with respect to the housing means.

2. The tuner of claim 1 wherein the housing means includes a cylindrically-shaped housing having a flange portion thereon, the flange portion including a bearing surface for contact with the string when the knob core is rotated with respect to the housing means.

3. The tuner of claim 2 wherein the flange portion includes a radial knurl for substantially preventing relative rotation between the housing and the instrument when the tuner is secured to the instrument.

4. The tuner of claim 2 wherein the housing includes a reduced diameter section and the annular means includes an annular member for interacting with the reduced diameter section to maintain the knob core in threaded relationship with the slider means.

5. The tuner of claim 2 wherein the housing includes threaded means for attaching the housing to the instrument.

6. The tuner of claim 1 also including a tuning knob, the knob core including groove means for locking the knob onto the knob core.

7. The tuner of claim 6 wherein the knob includes an outer knurled surface.

8. The tuner of claim 6 wherein the groove means includes a circular groove surrounding the knob core, and the knob includes at least one set screw for insertion into the groove.

9. The tuner of claim 1 wherein the slider means also includes clamping means for securing the string in the string opening.

10. The tuner of claim 2 wherein the locking means includes a locking pin extending from the slider means, and the housing includes axially extending slot means terminating at one end thereof at the flange portion without intersecting the bearing surface for interacting with the locking pin to secure the slider means and the knob core in the housing.

11. The tuner of claim 1 wherein the instrument includes plain strings and wound strings, the slider means includes clamping means for securing a string in the string opening, and the string opening includes string securing surface means for interacting with the clamping means to secure a plain string without substantially deforming the string to avoid breakage of the plain string.

12. The tuner of claim 11 wherein the clamping means includes a clamping member having a clamping face of predetermined radius of curvature, and the string securing surface means includes a securing surface in the string opening for distributing the force of the clamping means on the string, the securing surface having a radius of curvature which exceeds the predetermined radius of curvature by at least the thickness of the largest plain string but less than the thickness of any of the wound strings on the instrument, the string being secured between the securing surface and the clamping face.

13. The tuner of claim 1 wherein the instrument includes plain strings and wound strings, and the slider means includes clamping means for securing a string in the string opening, including a clamping face having an outer ring and a central depression, and the string opening includes a securing surface in the opening, for increased pinching of a wound string between the outer ring and the securing surface.

14. The tuner of claim 1 wherein the slider means includes clearance means for receiving the string as the slider means is drawn into the housing means upon rotation of the knob core.

15. The tuner of claim 13 wherein the clearance means includes at least one cutaway portion adjacent to the string opening for receiving excess string exiting the opening without interfering with movement of the slider means into the housing means during tuning of the string.

16. The tuner of claim 2 wherein the bearing surface includes a substantially smooth curved surface completely surrounding the housing.

17. A gearless tuner for rapid installation on the neck of a guitar in a standard headstock hole of specified diameter, comprising:

a generally cylindrical housing means for mounting on the instrument, including a housing having an axial opening extending therethrough, and a flange portion thereon, the flange portion including a substantially smooth curved bearing surface for contact with the string;

a knob core sized for insertion into the axial opening in the housing means, including a threaded aperture extending axially therethrough, and annular ring means for interacting with the housing; and elongated slider means extending into the axial opening of the housing and axially threaded into the aperture for securing one end of a string of the instrument and drawing the string into the housing when the knob core is rotated with respect to the housing to tension the string, including a string opening through the slider means substantially parallel to the direction of the string on the instrument for receiving the string, and locking means both for allowing the slider to move axially with respect to the housing and preventing the slider from rotating with respect to the housing.

18. The tuner of claim 17 wherein the diameter of the housing means is less than $\frac{3}{8}''$.

19. A method of installing a tuning machine in a preexisting hole on a guitar neck, comprising the steps of:

inserting a subassembly, including a cylindrical housing having a flange on one end and threads on the other end, a knob core substantially within the housing having an axial threaded aperture and a slider threaded into the aperture for movement into the housing, through the hole in the guitar neck;

attaching a nut onto the threaded end of the housing to secure the subassembly to the neck; and mounting a tuning knob on an end of the knob core.

20. The method of claim 18 wherein the step of mounting the tuning knob includes the steps of installing a friction-reducing washer onto the knob core and fastening a set screw in the knob into a groove on the knob core for fixing the knob to the core for rotation therewith.

21. The method of claim 19 also including the step of placing a spacer on the housing before attaching the nut.

* * * * *